United States Patent [19]

Schneider et al.

[11] Patent Number: 5,072,919

[45] Date of Patent: Dec. 17, 1991

[54] VERSATILE FOLDING APPARATUS TO PROVIDE FOLDED PRODUCTS OF SELECTIVELY DIFFERENT FOLDING PATTERNS

[75] Inventors: Eckhard Schneider, Stadtbergen; Erwin Saalfrank, Neusäss, both of Fed. Rep. of Germany

[73] Assignee: MAN ROLAND Druckmaschinen AG, Offenbach am Main, Fed. Rep. of Germany

[21] Appl. No.: 551,132

[22] Filed: Jul. 10, 1990

[30] Foreign Application Priority Data

Aug. 1, 1989 [DE] Fed. Rep. of Germany ..... 3925398

[51] Int. Cl.[5] ..... B42C 1/00

[52] U.S. Cl. ..... 270/49; 270/21.1; 270/47; 270/6; 270/50; 493/426

[58] Field of Search ..... 270/6, 7, 8, 9, 10–19, 270/21.1, 47–50; 493/426–429

[56] References Cited

U.S. PATENT DOCUMENTS

| | | | |
|---|---|---|---|
| 2,164,370 | 7/1939 | Zuckerman | 270/47 |
| 4,279,410 | 7/1981 | Bolza-Schüneman | 270/6 |
| 4,564,470 | 1/1986 | Schmitt | 270/5 |

FOREIGN PATENT DOCUMENTS

| | | | |
|---|---|---|---|
| 2517000 | 10/1976 | Fed. Rep. of Germany . | |
| 93771 | 7/1980 | Japan | 270/47 |

*Primary Examiner*—Edward K. Look
*Assistant Examiner*—Therese M. Newholm
*Attorney, Agent, or Firm*—Frishauf, Holtz, Goodman & Woodward

[57] ABSTRACT

A web (17) received, for example, from an 8-page or 16-page printing machine, is severed in a cutter blade cylinder (6) needle-tucking blade cylinder (7) combination and the severed sheets are provided with a cross fold in a first system (A) formed by the combination needle-tucking blade cylinder (7) and a combination needle-cutter blade cylinder (12), to be then further cross-folded and cut in a second system formed by the combination of the needle-cutter blade cylinder (12) with a needle-folding jaw cylinder (13). To permit the second combination to be operative, the combination needle-cutter blade cylinder (12) is additionally formed with tucking blades (21) for engagement in the folding jaws (22) of the needle-folding jaw cylinder (13). This arrangement permits double cutting and folding, for example, of longitudinally folded superimposed webs into, selectively, $8\frac{1}{2}'' \times 11''$ or A4 products and cross-folding them to $5\frac{1}{2}'' \times 8\frac{1}{2}$ or A5 products.

13 Claims, 2 Drawing Sheets

VERSATILE FOLDING APPARATUS TO PROVIDE FOLDED PRODUCTS OF SELECTIVELY DIFFERENT FOLDING PATTERNS

REFERENCE TO RELATED PUBLICATION

German Patent 25 17 000, Kühn, assigned to a predecessor company of the present application.

FIELD OF THE INVENTION

The present invention relates to a folding apparatus, and more particularly to a folding apparatus which is adapted to be used in combination with printing machinery. The folding apparatus, especially, can be used to make, selectively, longitudinal folds and/or cross folds to provide, respectively, differently patterned longitudinally and/or cross-folded products to delivery apparatus.

BACKGROUND.

Folding apparatus to make longitudinal and/or cross-folded products are known; usually, a folding former, for example a folding cone or folding triangle, has one web, or several superimposed paper webs applied thereto. A cutter cylinder, operatively associated with a needling and folding or tucking blade cylinder receives the first longitudinally folded web or webs, and cuts it/them into predetermined lengths. A second longitudinal folding apparatus is coupled to a folding jaw cylinder, associated with the needle and tucking blade cylinder. The circumference of the needle and tucking blade cylinders may be so dimensioned that they can accommodate four cut lengths of the severed web or webs. A cutter and needling cylinder may be associated with the needle and tucking blade cylinder for delivery of products which are folded longitudinally only once. The diametrical relationship of the cutting blade and needling cylinder with respect to the needle and tucking blade cylinder may be, for example 3: 4.

The referenced German Patent 25 17 000 is directed to a folding apparatus of the above-described type. It can be used for 8-page machines and, especially, for 16-page machines. The apparatus does not make it possible, however, to provide a cross fold on folded products which have been cut twice at the circumference, for example to provide half-folded sheets, in which the fold is transversely across the longer side of the sheet. Typical sheets which are to be folded in half have a dimension of the metric standard size A4, that is, 21×29.7 cm or, for example 8½"×11". These sheets are to be half-folded, to the dimension of the metric standard size A5, that is, 210×148.5 mm or, for example, 5½"×8½". In either case, the cross-fold should be along the longer side of the smaller, folded sheet. The smaller folded sheets, for example of the metric standard size A5, or 5½"×8½", is frequently used for mailing, for example to fit standard 6"×9" envelopes. The apparatus described in the aforementioned German Patent 25 17 000 thus is limited with respect to versatility of folding and maximum possible productivity of the folding apparatus cannot be achieved.

THE INVENTION.

It is an object to improve the generally known apparatus above described and, for example, shown in the German Patent 25 17 000, so that cut products which have been cut twice at the circumference and already supplied with one longitudinal fold, can be cross-folded once more to bring them from the standard metric A4 format to the metric A5 format or, for example from 8½"×11" to 5½"×8½", with minimum additional equipment and apparatus.

Briefly, merely one additional cylinder is used in the folding apparatus, which is a combination needle and folding or tucking jaw cylinder which has folding jaws located between the needle rows of the cylinders. This cylinder is operatively associated with a combination needle and cutter blade cylinder, in which the combination needle and cutter blade cylinder is modified to include, additionally, folding or tucking blades to form a combination needle - cutter blade - tucking blade cylinder. The tucking blades are located between adjacent needle rows and cutter blades, the needle and folding jaw cylinder receiving folded products from the combination needle - cutter blade - tucking blade cylinder for subsequent delivery to a delivery system.

The arrangement has the advantage that with only minor modification of an existing cylinder, and addition of merely one further cylinder, the versatility of the apparatus is substantially enhanced.

DRAWINGS

DETAILED DESCRIPTION

Figure 1:
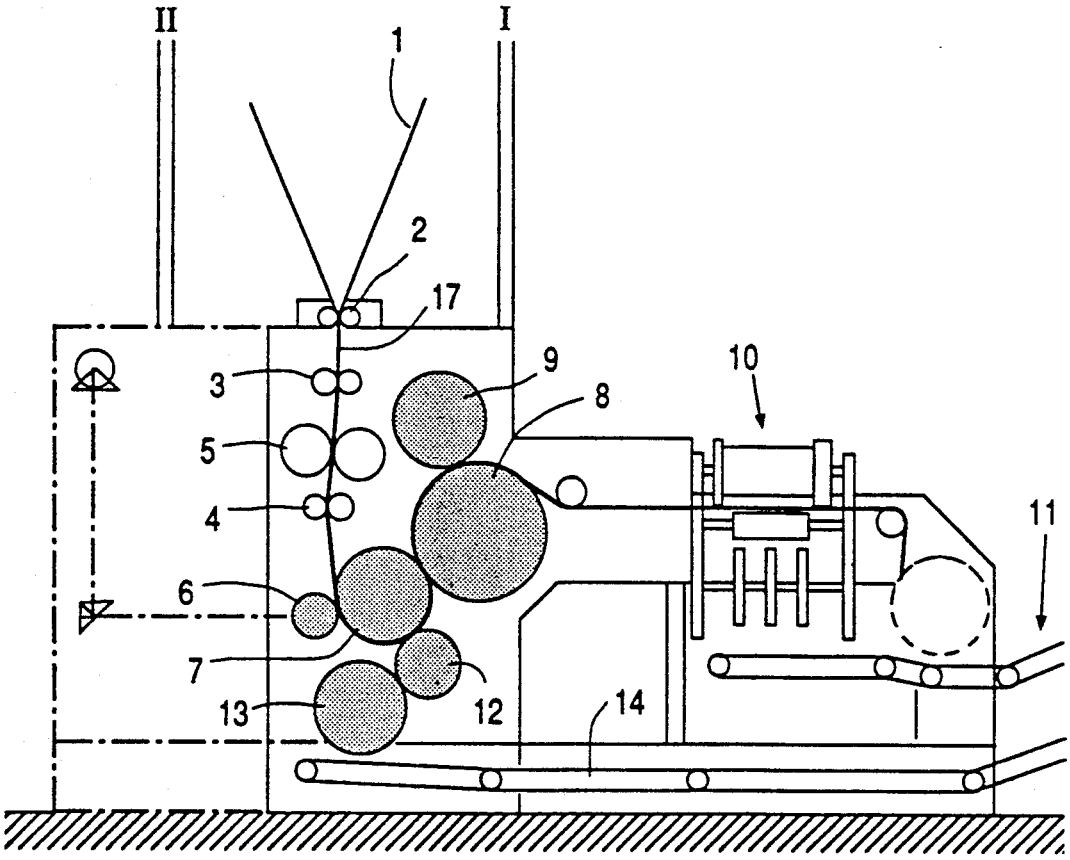
FIG. 1 is a highly schematic representation of a folding apparatus in accordance with the present invention.

Referring first to FIG. 1:

The folding apparatus is located, for example, between two side walls I and II . It includes a folding former 1, to form a first longitudinal fold in a web, for example a paper web received from a printing machine, for instance. More than one web can be folded by the former 1, for example by feeding a plurality of webs superimposed thereover. Downstream of former 1, in the direction of travel of the web, are bending rollers 2 to form an edge crease, a pair of drawing or pulling rollers 3, a cross perforation roller pair 5 and a further drawing or pulling roller pair 4.

One or more web or webs 17, in which, if more than one web is provided, the webs are superimposed and delivered, for example, from an 8-page printing machine or a 16-page printing machine, are fed after passing over the former 1, roller pairs 2, 3, 5 and 4 to the nip between a cutter blade cylinder 6 and a needle and tucking blade cylinder 7, in which the web is cut to sheets having, for example, the metric standard size DIN A3 or, for example, 11"×17". The cut products, for example formed by one or more printed web portion 17 are then, as known, guided over a folding jaw cylinder 8, which is associated with a gripper and folding blade cylinder 9, to be then conducted to a second longitudinal fold apparatus 10. The sheets, thus, are twice longitudinally folded and once cross-folded, and can then be delivered to a suitable delivery transport system 11.

There is an alternative way of handling, namely to supply the webs 17, after first cutting, to a combination cutter and needle cylinder 12, which is in engagement with the needle and tucking blade cylinder 7. The cylinder 12 cuts the sheets to the standard metric DIN A4 size, or to $8\frac{1}{2}'' \times 11''$. In accordance with the prior art, the so cut sheets and having only one longitudinal fold, then could be delivered to a delivery system 14.

In accordance with the present invention, an additional cylinder 13 is provided, which is a combination folding jaw-needle-delivery cylinder 13, adapted to cooperate with delivery or stripping levers 24 (FIG. 2), and, further, the combination cutter and needle cylinder 12 is expanded to provide tucking blades or folding blades 21 thereon, located respectively between two adjacent needle rows 16 and the cutter blades 18, which are normally located closely adjacent the needle rows.

Figure 3:
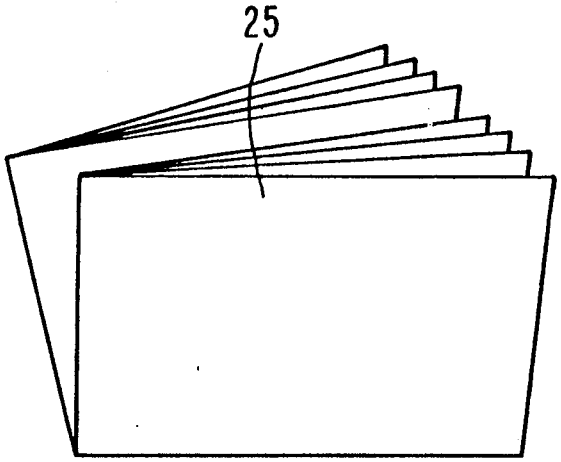
FIG. 3 is a perspective view of a folded product which can be made by the apparatus of the present invention in addition to conventionally folded products (not shown).

The folded products, made in accordance with the present invention and shown at 25 in FIG. 3, are then delivered over the delivery conveyor 14.

Figure 2:
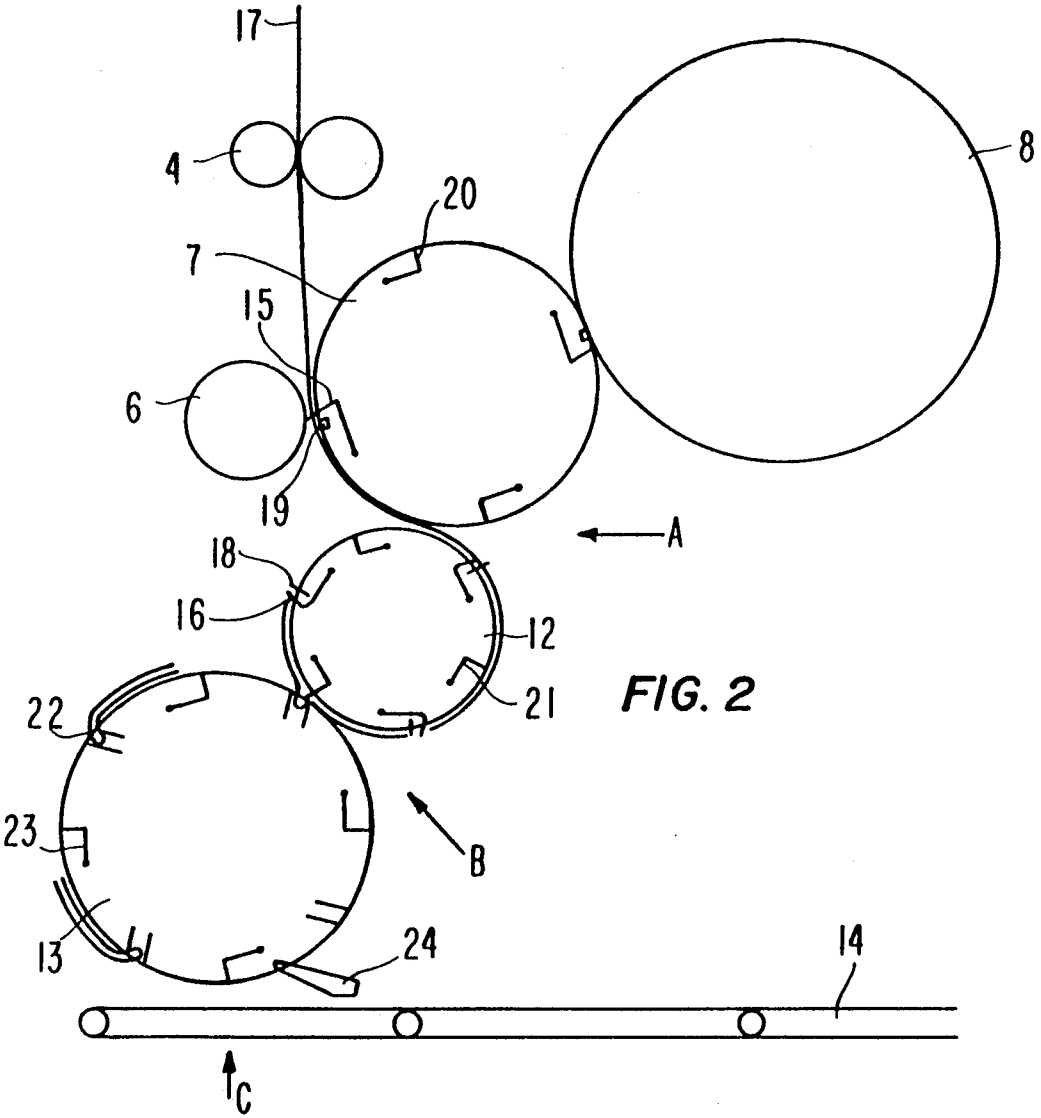
FIG. 2 is a detail view of a portion of the folding apparatus.

Referring to the detailed showing in FIG. 2:

The needle and tucking blade cylinder 7 is formed with cutting or counter grooves 19, with which the cutting blade 18 on the combination needle - cutter blade - tucking blade cylinder 12 can engage and cooperate. At the cutting or first system formed by the combination A of the needle - tucking blade cylinder 7 and the needle - cutter blade - tucking blade cylinder 12, web 17 is cut twice at the circumference, using the cutting grooves 19 of the cylinder 7 and the cutting blade 18 of the cylinder 12. The result will be a folded product having the metric dimension DIN A4 or $8\frac{1}{2}'' \times 11''$, respectively, and having a longitudinal fold. The folded products which are, typically, retained on the needle 16, in accordance with a feature of the invention, are folded in system B by the tucking blades 21 engaging in the folding jaws 22 of the combination needle - folding jaw cylinder 13. Consequently, the cut and folded product of metric size DIN A4 or of $8\frac{1}{2}'' \times 11''$, will be folded along the longer side to the DIN A5 format, or $5\frac{1}{2}'' \times 8\frac{1}{2}''$ as seen at 25 in FIG. 3.

The apparatus is versatile. If no folding to the smaller DIN A5 format, or $5\frac{1}{2}'' \times 8\frac{1}{2}''$ is to be done, the folding blades 21 of cylinder 12 are disabled, so that the sheets can be transferred to the cylinder 13 and held by the needles 23 on cylinder 13 until removed at a removal station C by suitable control of the removal or stripping lever 24. The folded products formed with only one longitudinal fold are placed on the removal or delivery conveyor 14. The system D, formed by the combination of cylinders 12 and 13, thus, can be selectively used for two different folded sizes of the folded products.

The relationship of the circumferences in system A of the combination cutting and needle cylinder 12 to the needle and tucking blade cylinder 7 is, preferably, 3 : 4. The relationship in system B of circumferences of the needle - folding jaw cylinder 13 to the needle - cutter blade - tucking blade cylinder 12 is preferably 4 : 3. Other circumferential or diametrical relationships are possible and may be used.

The system can provide folded products having two longitudinal folds 10, that is, folds in the direction of feed or supply of the web 17. If two longitudinal folds are to be made from webs delivered by an 8-page or a 16-page machine, and cut into sheets, the sheets are first needled or held by the needles 15 of the needle - folding blade cylinder 7 and transferred by the tucking blades 20 into suitable folding jaws - not specifically shown - of the folding jaw cylinder 8, for subsequent formation of a second longitudinal fold in the second longitudinal folding apparatus 10.

When operating in accordance with the present invention, that is by guiding the cut products over the cylinders 12 and 13, the needles 15 of the needle - tucking blade cylinder must be placed in inactive position and only the needles 16 of the combination needle - cutter blade - tucking blade cylinder 12 hold and grip the products which, then, by the tucking blades 21, in accordance with the present invention, are transferred to the folding jaws 22 of the combination needle - folding jaw cylinder 13 if it is desired to form the folded products 25 (FIG. 3) for delivery on the conveyor 14.

The change of the previously used cutter and needle cylinder 12 by adding tucking blades 21, and addition of the tucking blade - needle cylinder 13, thus can substantially increase the versatility of the apparatus.

The tucking blades, cutter blades, needles, and folding jaws can be operated or controlled by cams or the like, as well known in folding apparatus technology.

Various changes and modifications may be made within the scope of the inventive concept.

We claim:

1. A folding apparatus adapted to receive a traveling substrate web, for selectively providing products folded in accordance with different folding patterns, comprising a cutter blade cylinder (6);

a combination needle - folding or tucking blade cylinder (7) operatively associated with the cutter blade cylinder, for cutting a longitudinally folded web (17) into first longitudinally folded cut products, said needle - folding or tucking blade cylinder (7) having a circumference dimensioned to accept, circumferentially, a plurality of cut products;

a folding jaw cylinder (8) to form a first cross fold of the longitudinally folded, cut products;

a combination needle - cutter blade cylinder (12) operatively associated with the combination needle - folding or tucking blade cylinder (7), a needle - folding jaw - delivery cylinder (13) having needle rows (23) and folding jaws (22) located between the needle rows, operatively associated with the combination needle - cutter blade cylinder (12); and wherein the combination needle - cutter blade cylinder (12) additionally includes folding or tucking blades (21) to thereby form a combination needle - cutter blade - tucking blade cylinder (12), the tucking blades (21) being located between adjacent needle rows (16) and cutter blades (18) of said combination needle - cutter blade - tucking blade cylinder (12) for providing an additional fold into the folding jaws (22) of the needle - folding jaw - delivery cylinder (13) and permit delivery of the thus cut and folded products from said needle - folding jaw - delivery cylinder (13).

2. The apparatus of claim 1, wherein said needle - and - tucking blade cylinder (7) has a circumference dimensioned to accept four cut lengths of the web upon cutting a thereof by association of said combination needle - tucking blade cylinder (7) with said cutter blade cylinder (6).

3. The apparatus of claim 1, wherein the relationship of the circumference of the combination needle - cutter blade - tucking blade cylinder (12) to the circumference of the combination needle - tucking blade cylinder (7) is 3 : 4.

4. The apparatus of claim 3, wherein the relationship of the circumference of the needle - folding jaw-delivery cylinder (13) to the circumference of the combination needle - cutter blade - tucking blade cylinder (12) is 4 : 3.

5. The apparatus of claim 4, wherein said needle - and - tucking blade cylinder (7) has a circumference dimensioned to accept four cut lengths of the web upon cutting thereof by association of said combination needle - tucking blade cylinder (7) with said cutter blade cylinder (6).

6. The apparatus of claim 4, further including a removal or stripping means (24) operatively associated with the needle - folding jaw - delivery cylinder (13) for stripping products retained on the needle rows (23) off said needle - folding jaw - delivery cylinder (13).

7. The apparatus of claim 1, wherein the relationship of the circumference of the needle - folding jaw-delivery cylinder (13) to the circumference of the combination needle-cutter blade - tucking blade cylinder (12) is 4 : 3.

8. The apparatus of claim 7, further including a removal or stripping means (24) operatively associated with the needle - folding jaw - delivery cylinder (13) for stripping products retained on the needle rows (23) off said needle - folding jaw - delivery cylinder (13).

9. The apparatus of claim 1, wherein the relationship of the relative circumferential dimensions of the combination needle - tucking blade cylinder (7) and the combination needle - cutter blade - tucking blade cylinder (12) defines a first ratio;

wherein the relationship of the circumference of the combination needle - folding jaw - delivery cylinder (13) and the combination needle - cutter blade - tucking blade cylinder (12) defines a second ratio; and wherein said first and second ratios are, respectively, the reciprocals of each other.

10. The apparatus of claim 9, further including removal or stripping means (24) operatively associated with the needle - folding jaw - delivery cylinder (13) for stripping products retained on the needle rows (23) off said needle - folding jaw - delivery cylinder (13).

11. The apparatus of claim 1, wherein said combination needle - tucking blade cylinder (7) and said needle - folding jaw - delivery cylinder (13) have essentially the same diameter; and wherein said combination needle - cutter blade - tucking blade cylinder (13) is smaller than said needle - folding jaw - delivery cylinder (13).

12. The apparatus of claim 11, further including a removal or striping means (24) operatively associated with the needle - folding jaw - delivery cylinder (13) for stripping products retained on the needle rows (23) off said needle - folding jaw - delivery cylinder (13).

13. The apparatus of claim 1, further including a removal or striping means (24) operatively associated with the needle - folding jaw - delivery cylinder (13) for stripping products retained on the needle rows (23) off said needle - folding jaw - delivery cylinder (13).

* * * * *